US007659467B2

(12) United States Patent
Adams

(10) Patent No.: US 7,659,467 B2
(45) Date of Patent: Feb. 9, 2010

(54) DEVICE FOR ADJUSTING THE TENSION OF THE STRINGS OF A GUITAR OR OF A BASS

(75) Inventor: Christopher Adams, Hamburg (DE)

(73) Assignee: Tectus Anstalt, Vaduz (LI)

( * ) Notice: Subject to any disclaimer, the term of this patent is extended or adjusted under 35 U.S.C. 154(b) by 0 days.

(21) Appl. No.: 11/568,539

(22) PCT Filed: Mar. 24, 2005

(86) PCT No.: PCT/EP2005/003149

§ 371 (c)(1),
(2), (4) Date: Oct. 31, 2006

(87) PCT Pub. No.: WO2005/114647

PCT Pub. Date: Dec. 1, 2005

(65) Prior Publication Data

US 2007/0214933 A1 Sep. 20, 2007

(30) Foreign Application Priority Data

May 13, 2004 (EP) ..... 04011357

(51) Int. Cl.
*G10D 3/14* (2006.01)
*G10D 3/10* (2006.01)

(52) U.S. Cl. ..... 84/306; 84/7; 84/267; 84/297 R; 84/601

(58) Field of Classification Search ..... 84/7–9, 84/107, 112–114, 122–135, 144, 173, 263, 84/267, 303–306, 312 R, 454, 458, 653–656, 84/647, 671–673, 678–684
See application file for complete search history.

(56) References Cited

U.S. PATENT DOCUMENTS 3,130,626 A 4/1964 Martin (Continued)

FOREIGN PATENT DOCUMENTS

AT 006 906 U1 5/2004

(Continued)

*Primary Examiner*—Jeffrey Donels
*Assistant Examiner*—Christopher Uhlir
(74) *Attorney, Agent, or Firm*—Hunton & Williams LLP

(57) ABSTRACT

A device for adjusting the tension of the strings of a guitar having at least two strings, particularly an electric guitar or a bass, particularly an electric bass, in which each string of the guitar or bass is, with one end, wound on a turning peg of an adjusting mechanism mounted on the neck of the guitar or of the bass. The adjusting mechanism contains a combination consisting of a worm shaft and of a worm wheel and, due to these, is provided with a self-locking ability. The aim of the invention is to improve the design of a device of the aforementioned type so that, without considerably altering the basic shape of the guitar or of the bass, this device can automatically adjust the tension of individual strings of the instrument reliably and precisely whereby ultimately enabling them to be tuned. To this end, a drive unit for each adjusting mechanism is mounted on the neck of the guitar or of the bass. The drive unit is directly connected to the worm shaft or to the worm wheel (17) of this adjusting mechanism in order to drive the worm shaft or the worm wheel.

7 Claims, 4 Drawing Sheets

U.S. PATENT DOCUMENTS

| | | | | | |
|---|---|---|---|---|---|
| 3,813,983 | A | | 6/1974 | Paul | |
| 4,018,124 | A | * | 4/1977 | Rosado | 84/723 |
| 4,088,052 | A | | 5/1978 | Hedrick | |
| 4,128,033 | A | | 12/1978 | Petillo | |
| 4,197,779 | A | | 4/1980 | Holman | |
| 4,318,327 | A | | 3/1982 | Toups | |
| 4,426,907 | A | | 1/1984 | Scholz | |
| 4,681,010 | A | | 7/1987 | Wilkinson | |
| 4,791,849 | A | * | 12/1988 | Kelley | 84/458 |
| 4,803,908 | A | | 2/1989 | Skinn et al. | |
| 4,909,126 | A | * | 3/1990 | Skinn et al. | 84/454 |
| 5,065,660 | A | * | 11/1991 | de Buda | 84/200 |
| 5,265,513 | A | | 11/1993 | Smith | |
| 5,337,644 | A | | 8/1994 | Fishman et al. | |
| 5,343,793 | A | * | 9/1994 | Pattie | 84/454 |
| 5,390,579 | A | | 2/1995 | Burgon | |
| 5,767,429 | A | * | 6/1998 | Milano et al. | 84/454 |
| 5,986,190 | A | * | 11/1999 | Wolff et al. | 84/297 R |
| 6,184,450 | B1 | * | 2/2001 | LeBlanc | 84/307 |
| 6,184,452 | B1 | * | 2/2001 | Long et al. | 84/457 |
| 6,271,456 | B1 | | 8/2001 | Nelson | |
| 6,278,047 | B1 | | 8/2001 | Cumberland | |
| 2002/0104428 | A1 | | 8/2002 | Wilson | |

FOREIGN PATENT DOCUMENTS

| | | | |
|---|---|---|---|
| DE | 35 09 662 | A1 | 10/1986 |
| FR | 2 365 850 | | 4/1978 |
| GB | 2 226 910 | A | 7/1990 |
| WO | WO 97/04442 | | 2/1997 |
| WO | WO 01/67431 | A1 | 9/2001 |
| WO | WO 03/012774 | A1 | 2/2003 |
| WO | WO 2005/114647 | A1 | 12/2005 |
| WO | WO 2005/116984 | A1 | 12/2005 |
| WO | WO 2005/116985 | A1 | 12/2005 |
| WO | WO 2005/116986 | A1 | 12/2005 |
| WO | WO 2006/076928 | A2 | 7/2006 |

* cited by examiner

DEVICE FOR ADJUSTING THE TENSION OF THE STRINGS OF A GUITAR OR OF A BASS

BACKGROUND OF THE INVENTION

The present invention relates to a device for adjusting the tension of the strings of a guitar, in particular an electric guitar (1), or a bass guitar, in particular an electric bass guitar, having at least two strings. The present invention also relates to a device for automatically tuning the strings of a guitar or a bass guitar.

To correctly tune a guitar or a bass guitar, it is necessary to accurately adjust the tension of the strings that are strung between two points of attachment on these instruments, so that, as the string is struck, a standing wave of the correct frequency is created and thus the note desired is generated.

To this end, one of the two ends of the string of the guitar or bass guitar is, as a rule, rigidly affixed, for example, in a tremolo system block, and the second end of the string is wound around a so-called tuning peg and, by winding and unwinding the string on said tuning peg, it is possible to accurately tune the string. These tuning pegs are normally turned manually by means of peg winders which are turned to tension or loosen the string.

Especially in cases in which it is desirable for the string instrument to be tuned automatically, i.e., by means of a control unit which, based on a detected actual note of the struck string in comparison with a desired note, actuates a drive for changing the tension of the string, the tension of the strings must be changed automatically, i.e., by means of a drive.

A proposal for practically implementing such a device has been disclosed in U.S. Pat. No. 4,909,126. According to the teaching of this invention, all of the strings together are tensioned and loosened by means of a lever which is attached to the body of the guitar and which acts on all strings. This device, however, is relatively large and clumsy and, in particular, does not make it possible to accurately tune each separate string.

WO 03/012774 A1 describes servo drives, each one of which acts on a tuning peg of a guitar so as to adjust the tension of the string that is associated with the respective tuning peg. The manner in which the servo drives are connected to the tuning pegs, however, remains unclear. The patent only discloses that the servo drives should be located along the side on the head of the guitar.

SUMMARY OF THE INVENTION

The problem to be solved by the present invention is to make available a device of the type mentioned above, by means of which the tension of the separate strings of the instrument can be reliably and automatically adjusted, thereby tuning the strings, without any major changes to the basic shape of a guitar or bass guitar. It should also be possible to use this device to retrofit existing instruments.

This problem is solved according to the present invention by a device with the characteristics of on each adjusting mechanism, a drive unit is disposed on the head of a guitar or bass guitar, which drive unit is directly connected to the worm shaft or the worm wheel of this adjusting mechanism so as to be able to drive the worm shaft and the worm wheel.

An advantageous improved embodiment includes drive units comprised of a combination of a drive motor, preferably an electric motor, and a reduction gear.

Lastly, another embodiment of the invention discloses a device for automatically tuning the strings of a guitar or bass guitar which has a device designed according to the present invention for adjusting the tension of the strings of a guitar or bass guitar.

The principal idea behind the invention is to dedicate a separate drive to each adjusting mechanism, which drive is directly connected to the worm wheel associated with the adjusting mechanism and to the associated worm shaft. Even in conventional guitars without an automatic drive for adjusting the tension of the strings, the tuning pegs are connected via a combination of a worm wheel and a worm shaft to means for turning the tuning pegs. In the conventional guitars, such means are the so-called peg winders. In guitars and bass guitars, the combination of the worm wheel and the worm shaft causes the adjusting mechanism to automatically lock, which prevents the tensioned string that is wound around a tuning peg from moving the tuning peg by means of its string tension, thereby ultimately loosening the string.

Since according to the present invention the drive is directly connected to the worm shaft and the worm wheel, this automatic locking action also comes into play between the tuning peg and the drive so that the drive is not required to constantly exert a force so as to maintain the string in the desired tension. Instead, the drive can be activated solely to adjust the string and can be inactivated after the desired tension of the string has been successfully set. The automatic locking action existing between the drive and the tuning peg thus prevents the tuning peg from unwinding and maintains the string in the tension desired.

As mentioned, the design of the device according to the present invention, on the one hand, does not require the use of drives, each of which has its own automatic locking action. On the other hand, the drives can be attached directly to the adjusting mechanisms comprising the tuning pegs and the peg winders, thus making it possible to attach them relatively inconspicuously to the head of the guitar or bass guitar in a manner that saves space and reduces the weight.

According to an advantageous improved embodiment of the invention that is disclosed in claim 2, the drives may be comprised of a combination of a drive motor and a reduction gear. Preferably, the drive motor is an electric motor. The reduction gear makes it possible to use a motor of generally small dimensions with a low torque output and yet, because of the reduction, to generate the torques necessary to adjust the strings. The drive can be a compact unit comprising the motor and the reduction gear, but it can also be composed of two components, i.e., a separate motor and a separate reduction gear.

The device according to the present invention is especially suitable for use in a device for automatically tuning the strings of a guitar or bass guitar. An actual note of a struck string is detected by a detection device; from there said note is transmitted to a comparison device where it is compared with a desired note that is stored in a storage device. Based on this comparison, the drive associated with this string is actuated by a control unit, which causes the string to be correctly adjusted until the actual note and the desired note coincide.

Additional advantages and characteristics of the present invention follow from the subsequent description of a practical example based on the appended figures. As can be seen:

DETAILED DESCRIPTION OF THE INVENTION

Figure 1:
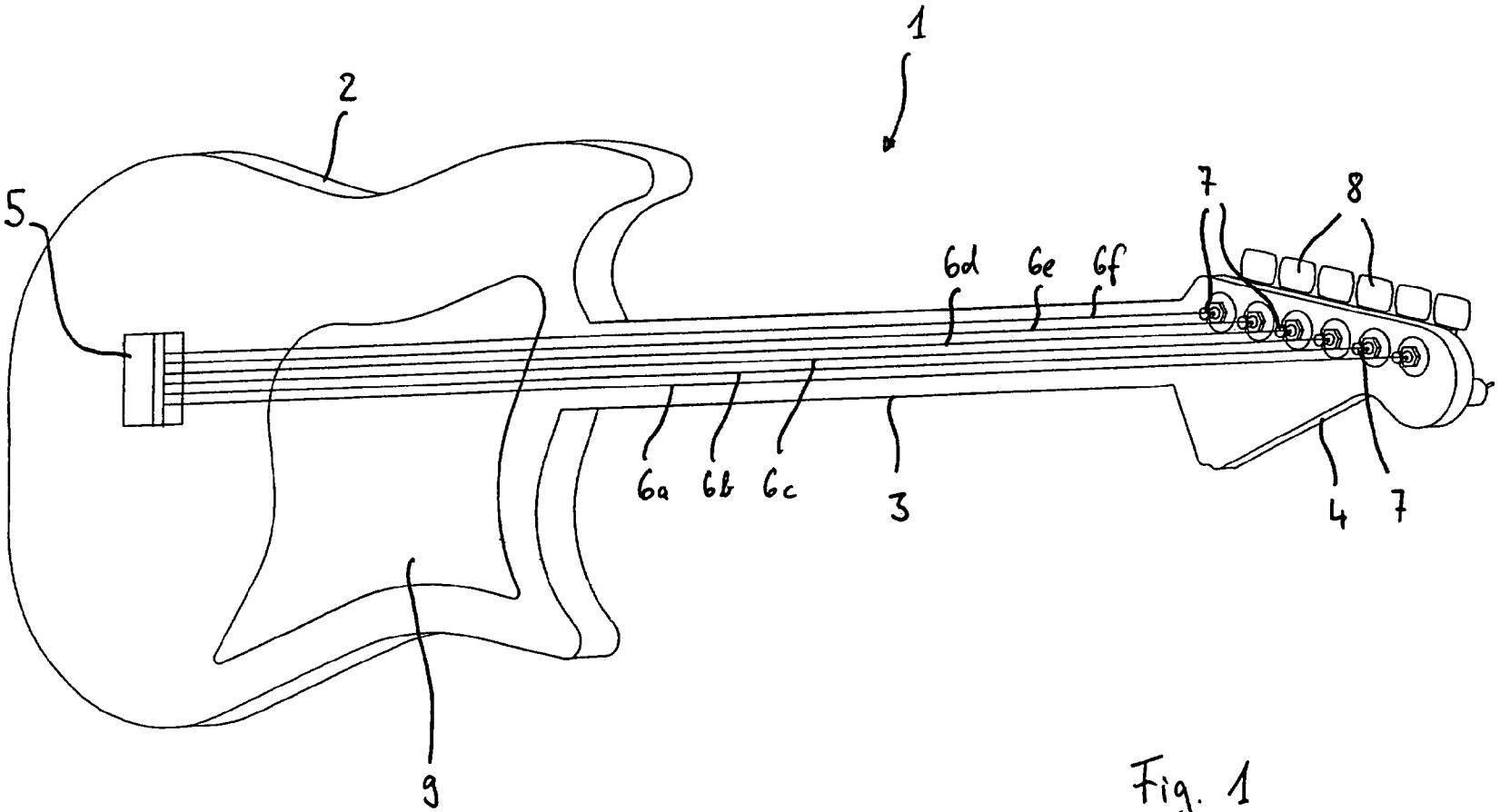
FIG. 1 shows a diagrammatic representation of an electric guitar in which the invention is implemented in a three-dimensional view.

In the figures, identical elements are designated by the same reference numerals.

Figure 2:
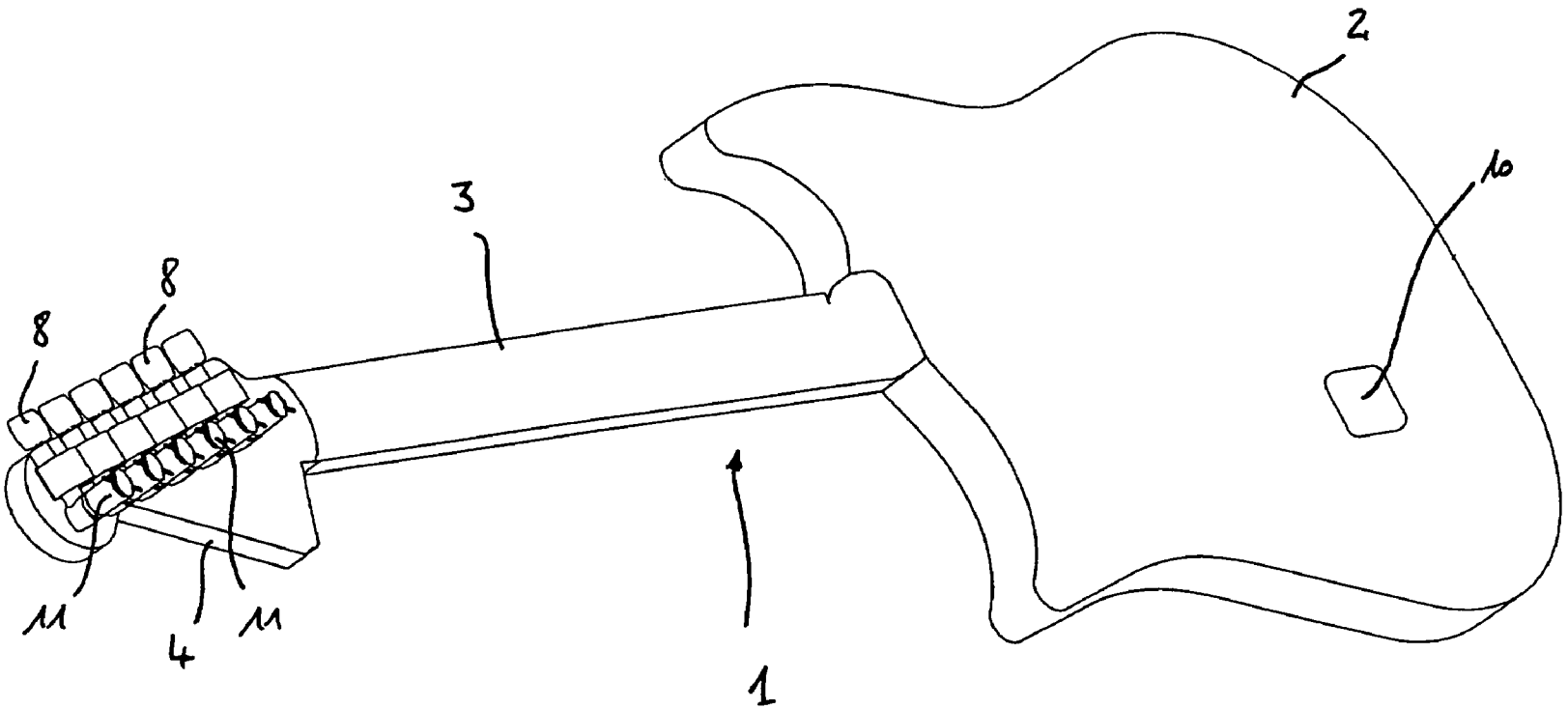
FIG. 2 shows a diagrammatic representation of the electric guitar shown in FIG. 1 in a three-dimensional view from the rear.

In FIGS. 1 and 2, an electric guitar 1 is diagrammatically shown in a three-dimensional view, once from the front and once from the rear. This guitar can be roughly divided into a body 2, a neck 3 and a head 4. On body 2, a fixing block, in this case a tremolo system block 5, is disposed, in which fixing block the first ends of strings 6*a*-6*f* of the guitar are held in place. From body 2, strings 6*a*-6*f* extend via neck 3 up to head 4 of the guitar where they are wound around tuning pegs 7. These tuning pegs 7 are connected via adjusting mechanisms to peg winders 8 which, when turned, turn the tuning pegs 7, thus making it possible to adjust the tension of strings 6*a*-6*f*. In the adjusting mechanisms, of which only the tuning pegs 7 and the peg winders 8 can be seen, a combination of a worm wheel and a worm shaft is disposed between the tuning pegs 7 and the peg winders 8, which combination causes each respective adjusting mechanism to lock automatically. This means that a string 6*a*-6*f* that is strung up under tension by turning the respective peg winder 8 of the associated tuning peg 7 cannot loosen as a result of the force exerted by the tension of the string on the tuning peg 7. Instead, the tuning peg 7 is held in place by the automatic locking action that is caused by the interaction between the worm wheel and the worm shaft and thus holds string 6*a*-6*f* in tension.

FIG. 1 also shows that a so-called pickguard 9 is disposed on body 2 of guitar 1 below strings 6*a*-6*f*.

In FIG. 2, it can be seen that a control unit 10 is disposed on the body, which control unit will be discussed later, but which is not necessarily an integral component of the invention.

Of greater importance in this representation are the drives 11 which are attached directly to the adjusting mechanisms. In this example, drives 11, by way of an output shaft, are directly connected to the adjusting mechanism associated with the respective worm shaft and thus are able to utilize the automatic locking action of these adjusting mechanisms, so that it is not necessary for each drive to have its own separate automatic locking action. The drives shown in this practical example are comprised of an electric motor and a downstream reduction gear, with this combination not having an automatic locking action. The output shaft of the gear unit of drive 11 is connected via a simple gearwheel combination directly to the worm shaft of the mechanism, of which the associated tuning peg 7 is an integral component.

Figure 3:
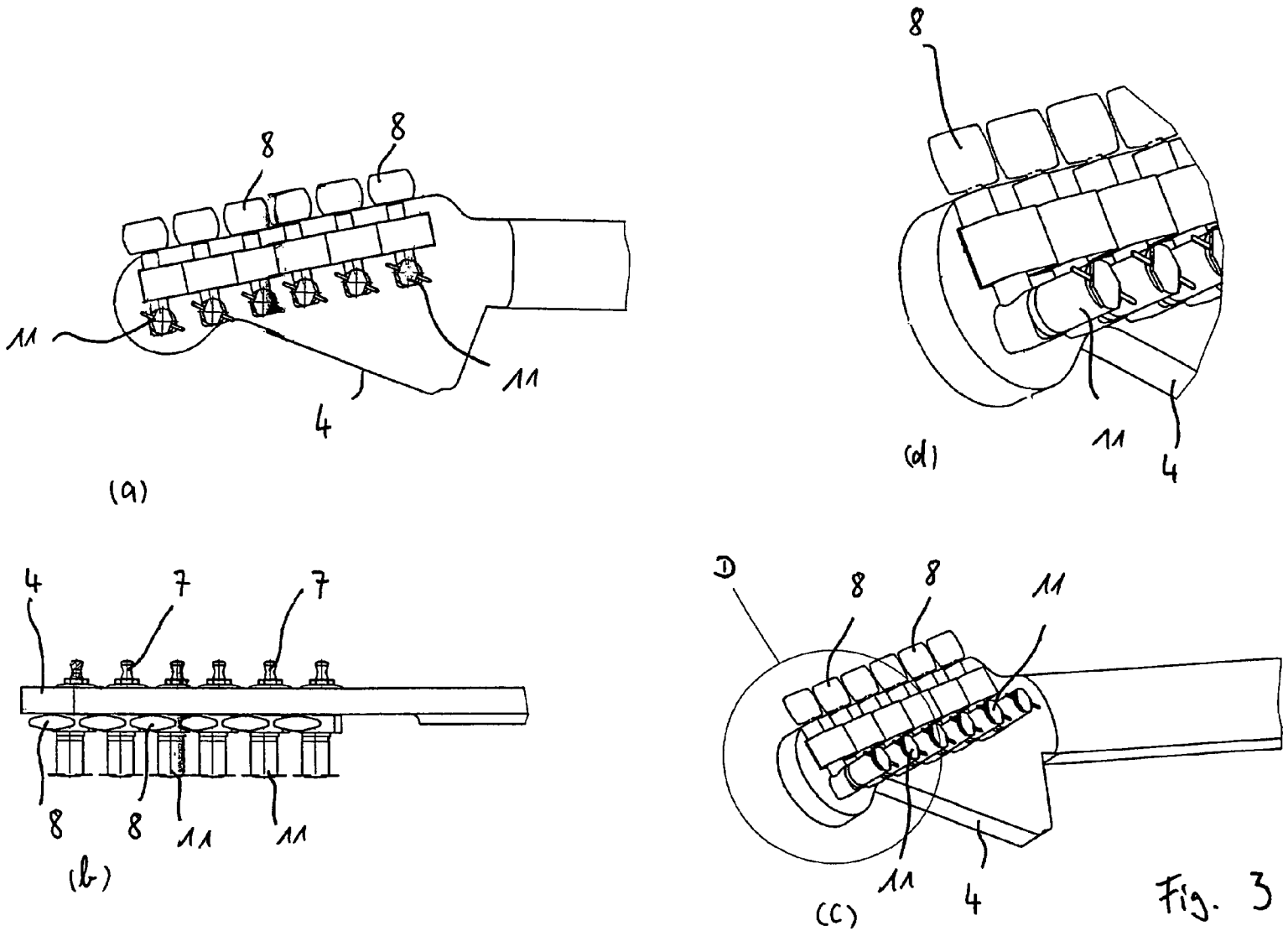
FIG. 3 shows four different views (*a*)-(*d*) of enlarged representations of the drives that are disposed on the head of the guitar.

The drives 11 and their configuration on the adjusting mechanisms comprising tuning the pegs 7 and the peg winders 8 are once again shown in greater detail in FIG. 3(*a*)-(*d*), with FIG. 3(*d*) being an enlargement of the portion identified by reference D in FIG. 3(*c*).

Figure 4:
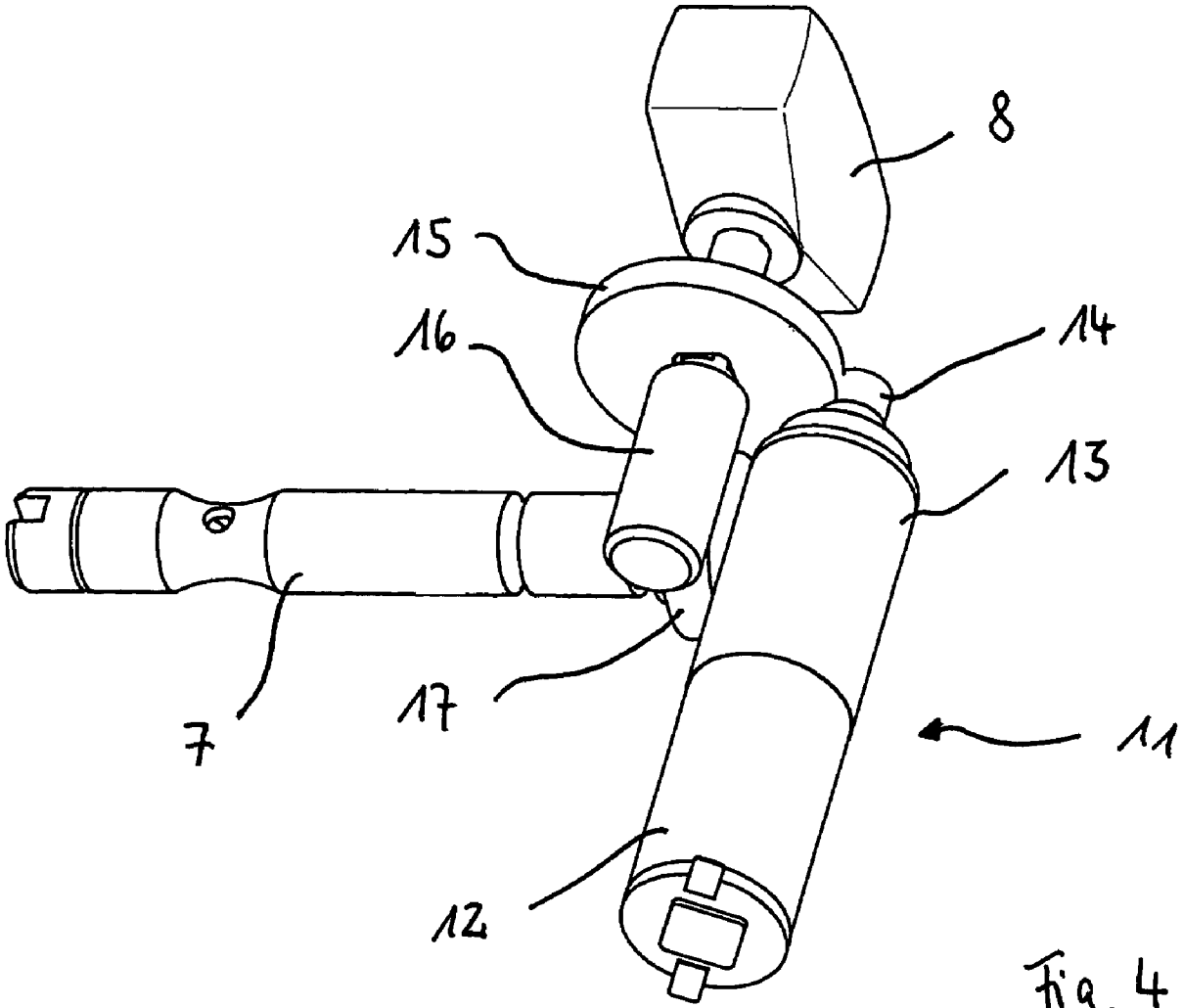
FIG. 4 shows a diagrammatic representation of the adjusting mechanism in a three-dimensional view, which shows the interaction between the drive and the combination of the worm shaft and the worm wheel of the adjusting mechanism.

FIG. 4 is an enlarged diagrammatic view of the adjusting mechanism with drive 11 connected to it, without a housing that may potentially encase the mechanism. In this figure, the principal interaction between the tuning peg 7, the peg winder 8 and the drive 11 is illustrated. Drive 11 is comprised of a motor 12, which in this case is an electric motor, and a gear unit 13 which is a reduction gear. In this figure, the motor and the gear unit are represented only diagrammatically. A gearwheel 14 is disposed on an output shaft of the gear unit, which gearwheel meshes with a gearwheel 15 that engages in a worm shaft 16. Gearwheels 14 and 15 can basically be thought of as integral components of the gear unit 13 that is disposed downstream of motor 12. Gearwheels 14 and 15 create an additional reduction.

As a result of the above-described configuration shown in FIG. 4, drive 11 is directly connected to the worm shaft 16 of the adjusting mechanism. This adjusting mechanism in turn meshes with a worm wheel 17 that is disposed on the tuning peg 7, which causes the adjusting mechanism to lock automatically.

In the electric guitar 1 illustrated in the practical example, drives 11 are incorporated into a device for automatically tuning the instrument. Integral components of this device are a detection device (not shown) for detecting a note of a struck string 6*a*-6*f*, a storage device (not shown in detail) in which a desired note of the respective string 6*a*-6*f* or data associated with this desired note is/are stored, a comparison device for comparing the stored desired note with the detected actual note or with the data associated with these notes, such as frequency or the like, the control unit 10 and the drives 11.

To automatically tune the guitar, a string 6*a*-6*f* of the guitar is struck, the note generated thereby is detected by the detecting device and transmitted to the comparison device. In the comparison device, this note or the data associated with this note is/are compared with the actual note or the data associated with this actual tone retrieved from the storage device, and the result of this comparison is transmitted to the control unit 10. The comparison device as well as the storage device can also be an integral component of the control unit 10. Subsequently, the control unit 10 transmits the control signals to the drive 11 that is associated with the tuning peg 7, around which the struck string 6*a*-6*f* is wound, and causes this drive to turn the associated tuning peg 7 in such a manner that the tension of the associated string 6*a*-6*f* is changed so that, when said string is struck, it sounds the desired note.

The device according to the present invention for adjusting the tension of the strings of a guitar or bass guitar can preferably be used in such a device for automatically tuning such an instrument, but is can also be used separately from such an automatic tuning device.

LIST OF REFERENCE NUMERALS

1 Guitar
2 Body
3 Neck
4 Head
5 Tremolo system block
6*a*-*f* String
7 Tuning peg
8 Peg winder
9 Pickguard
10 Control unit
11 Drive
12 Motor
13 Gear unit
14 Gearwheel
15 Gearwheel
16 Worm shaft
17 Worm wheel

What is claimed is:

1. A device for adjusting the tension of strings of a guitar or a bass guitar comprising at least two strings, with one end of each string wound around a respective tuning peg coupled to a respective automatically locking adjusting mechanism disposed on the head of the guitar or bass guitar, wherein each adjusting mechanism includes a combination of a worm shaft and a worm wheel coupled directly to the tuning peg and between a manual peg winder and at least one motor-driven gear of the respective string; and at least one motor per string coupled to the at least one motor-driven gear, wherein each at least one motor per string is disposed at the head of the guitar or bass guitar proximal to the respective tuning peg and distal to the peg winder.

2. The device according to claim 1, wherein the at least one motor-driven gear includes a reduction gear.

3. The device according to claim 2, further comprising a detection device for detecting a note generated by a struck string that is to be tuned, a storage device for storing a desired note for each of the strings, a comparison device for comparing the note detected by the detection device with the desired note for the struck string and a control unit for actuating the respective adjusting mechanism to adjust the tension of at least the struck string.

4. The device according to claim 1, further comprising a detection device for detecting a note generated by a struck string that is to be tuned, a storage device for storing a desired note for each of the strings, a comparison device for comparing the note detected by the detection device with the desired note for the struck and a control unit for actuating the respective adjusting mechanism to adjust the tension of at least the struck string.

5. The device according to claim 2, wherein the at least one motor per string is an electric motor.

6. The device according to claim 3, wherein the at least one motor per string is an electric motor.

7. The device according to claim 1, wherein the at least one motor per string is an electric motor.

* * * * *